US007762549B2

(12) United States Patent
Hirai

(10) Patent No.: US 7,762,549 B2
(45) Date of Patent: Jul. 27, 2010

(54) RECORDING APPARATUS

(75) Inventor: Yasuyuki Hirai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 11/760,490

(22) Filed: Jun. 8, 2007

(65) Prior Publication Data

US 2007/0284812 A1 Dec. 13, 2007

(30) Foreign Application Priority Data

Jun. 9, 2006 (JP) ..... 2006-161052

(51) Int. Cl.
*B65H 5/34* (2006.01)

(52) U.S. Cl. ..... 271/270; 271/3.14; 271/3.17; 271/3.2; 271/902; 347/104

(58) Field of Classification Search ..... 271/225, 271/270, 902, 272, 3.14, 3.15, 3.17, 3.18, 271/3.2; 347/104; 400/579, 582, 578, 636, 400/637, 637.1, 645, 706; 399/68, 396
See application file for complete search history.

(56) References Cited

U.S. PATENT DOCUMENTS 5,581,293 A * 12/1996 Wiklof ..... 347/139
5,602,571 A * 2/1997 Suda et al. ..... 346/134
6,168,333 B1 * 1/2001 Merz et al. ..... 400/634
6,290,351 B1 * 9/2001 Merz ..... 347/104
6,428,224 B1 * 8/2002 Askren et al. ..... 400/582
6,471,351 B1 * 10/2002 Ishikawa et al. ..... 347/104
6,612,679 B1 9/2003 Kawamata
6,761,425 B2 * 7/2004 Kawaguchi et al. ..... 347/16
6,827,421 B2 * 12/2004 Nunokawa et al. ..... 347/19
7,401,913 B2 * 7/2008 Nishiberi et al. ..... 347/104
7,410,167 B2 * 8/2008 Koga et al. ..... 271/266
7,568,696 B2 * 8/2009 Henson ..... 271/270
7,597,322 B2 * 10/2009 Suzuki et al. ..... 271/265.02
7,621,518 B2 * 11/2009 Iesaki et al. ..... 271/3.14
2004/0239742 A1 * 12/2004 Hiraki et al. ..... 347/104
2007/0031175 A1 * 2/2007 Takeda et al. ..... 400/636
2007/0200888 A1 * 8/2007 Inoue et al. ..... 347/16
2009/0066018 A1 * 3/2009 Iesaki et al. ..... 271/272
2009/0250863 A1 * 10/2009 Hirate et al. ..... 271/4.1

* cited by examiner

*Primary Examiner*—Patrick Mackey
*Assistant Examiner*—Jeremy Severson
(74) *Attorney, Agent, or Firm*—Canon USA Inc IP Div

(57) ABSTRACT

A recording apparatus includes a feeding section configured to feed a recording sheet, a first conveyance roller which conveys the recording sheet fed from the feeding section to a recording area and conveys the recording sheet during a recording operation, a recording section configured to record an image on the recording sheet at the recording area downstream from the first conveyance roller in the direction of feeding the recording sheet, a conveyance rate detection unit configured to detect the conveyance rate of the recording sheet conveyed by the first conveyance roller, a recording sheet end detection unit disposed downstream from the first conveyance roller and detects the end part of the recording sheet, and a correction unit configured to correct the conveyance rate of the recording sheet conveyed by the first conveyance roller based on a result detected by the conveyance rate detection unit.

13 Claims, 5 Drawing Sheets

RECORDING APPARATUS

BACKGROUND OF THE INVENTION

1. Field of the Invention

The present invention relates to a recording apparatus for performing recording in a recording section while the conveyance rate of a recording sheet is controlled by a conveyance roller.

2. Description of the Related Art

A recording apparatus feeds a recording sheet from a sheet feeding section and records an image on a recording area in a recording section while the recording area is conveyed by a conveyance roller. A rubber roller has been widely used as the conveyance roller. However, from the viewpoint of the conveyance rate, the rubber roller is susceptible to an external disturbance such as usage environment and degraded durability compared to a metal roller. Therefore, in order to realize excellent recording on the recording sheet, the conveyance rate needs to be corrected so as to correspond to a recording condition.

Further, in recent years, recording sheets diversify into various types such as glossy paper and photographic tone paper. Since the conveyance rate of the conveyance roller varies depending on the types of recording sheets, the correction of the conveyance rate is also required for each type of recording sheet.

As a method for correcting the conveyance rate, Japanese Patent Application Laid-Open No. 10-34901 discusses a method in which a reflection type sensor for detecting a sheet is mounted on a carriage serving as the recording section, two lines are recorded on the sheet, and thereafter a feeding rate between two lines is read by the reflection type sensor and a correction amount is calculated.

Further, according to Japanese Patent Application Laid-Open No. 2001-18371 (corresponding to U.S. Pat. No. 6,612,679) and No. 2001-277673, a test pattern is printed on the sheet to calculate the feeding rate based on a printing state so that the conveyance rate is corrected.

However, all of the above-described conventional techniques calculate the feeding rate from information about the recorded test pattern or the like, and therefore, unnecessary images are recorded in the recording sheet.

SUMMARY OF THE INVENTION

The present invention is directed to a recording apparatus capable of correcting the conveyance rate of a conveyance roller without performing recording on a recording sheet.

According to an aspect of the present invention, a recording apparatus includes a feeding section for feeding a recording sheet, a first conveyance roller disposed downstream relative to the feeding section in the direction of feeding the recording sheet so as to convey the recording sheet fed from the feeding section to a recording area and convey the recording sheet during recording, a recording section for recording an image on the recording sheet at the recording area downstream from the first conveyance roller in the direction of feeding the recording sheet, a conveyance rate detection unit configured to detect the conveyance rate of the recording sheet by the first conveyance roller, a recording sheet end detection unit disposed downstream from the first conveyance roller in the direction of feeding the recording sheet and configured to detect the end part of the recording sheet, and a correction unit configured to correct the conveyance rate of the recording sheet by the first conveyance roller based on a result detected by the conveyance rate detection unit and the recording sheet detection unit, wherein the first conveyance roller conveys the recording sheet until the recording sheet detection unit detects the end part of the recording sheet before the recording section starts recording.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
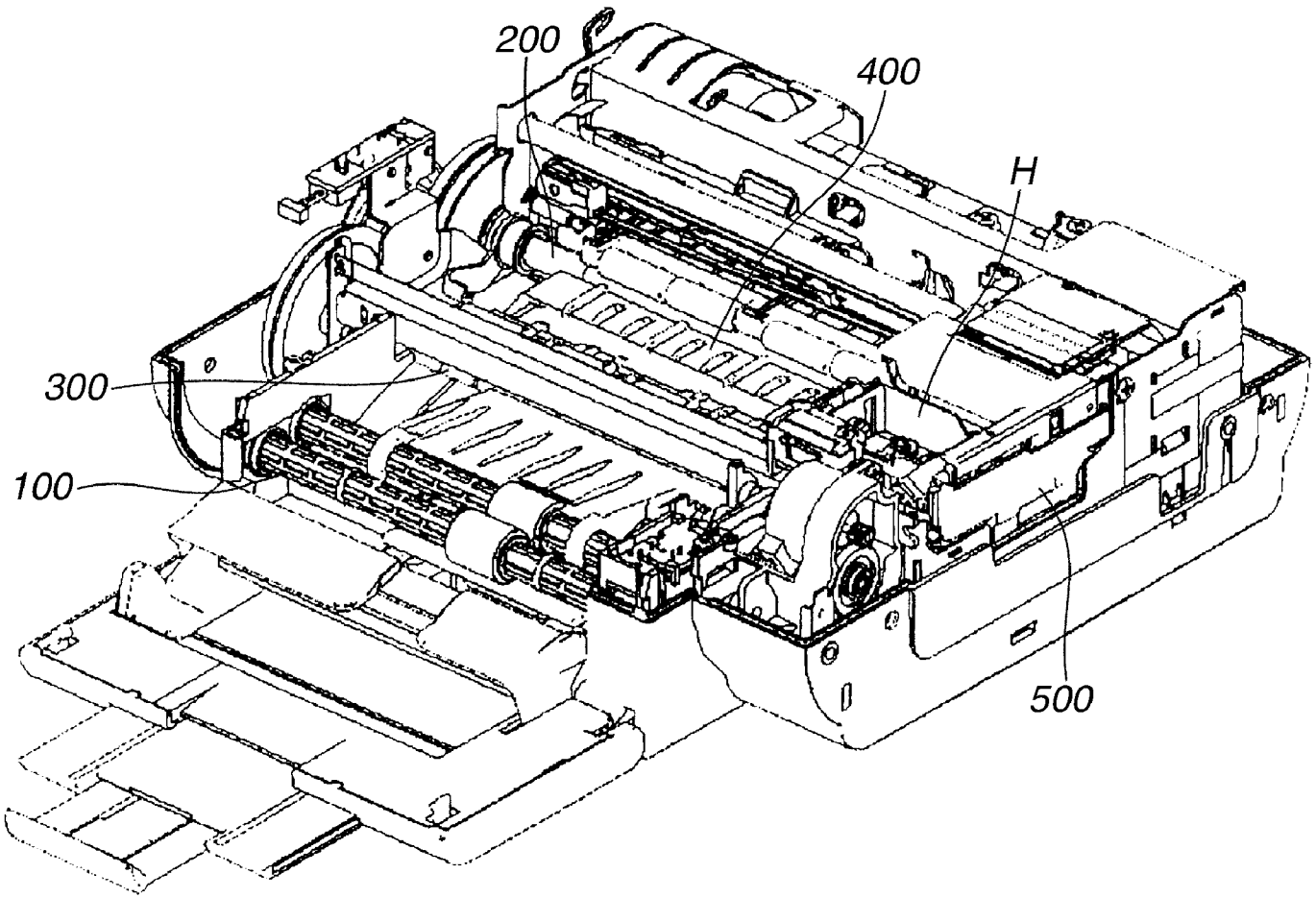
FIG. 1 is a perspective view illustrating a recording apparatus according to a first exemplary embodiment of the present invention.

FIG. 1 is a perspective view illustrating a recording apparatus according to a first exemplary embodiment of the present invention.

The recording apparatus in the present exemplary embodiment includes a sheet feeding section 100 for feeding a recording sheet to a recording position, a conveyance section 200, a discharge section 300 which is positioned before the conveyance section 200, a recording section 400 for recording an image on the recording sheet, and a carriage section 500 for scanning with a recording head H.

Figure 2:
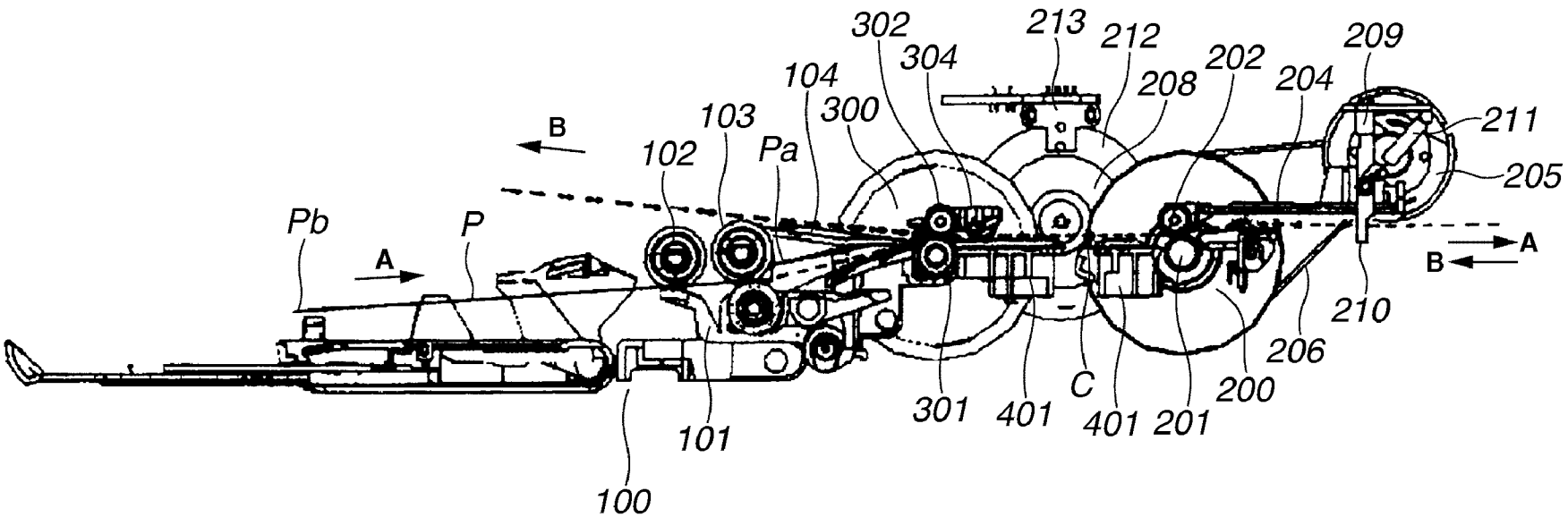
FIG. 2 is a cross sectional view illustrating a recording apparatus according to a first exemplary embodiment of the present invention.

FIG. 2 is a cross sectional view illustrating the sheet feeding section 100, the conveyance section 200, the discharge section 300, and the recording section 400. The sheet feeding section 100 is driven by a sheet feed motor (not shown). When the sheet feed motor rotates, a pressing plate 101 with stacked sheets is lifted up (FIG. 2 shows the pressing plate which is lifted up), and a recording sheet P abuts a sheet feeding roller 102. Then, the sheet feeding rollers 102 and 103 rotate to feed an uppermost recording sheet P.

The recording sheet P fed from the sheet feeding section 100 passes over the recording section 400 conveyed by the discharge section 300 and the conveyance section 200 in a direction A. After the recording sheet P passes through a recording start position C, the conveyance section 200 conveys the recording sheet P in a direction B to the recording start position C. When recording is completed, the recording sheet P is discharged onto a sheet discharge tray 104 by the discharge section 300.

The discharge section 300 conveys the recording sheet P fed from the sheet feeding section 100 to the recording start position C. This discharge section 300 includes a sheet discharge roller 301, a sheet discharge pinch roller 302, and a sheet discharge pinch roller holder 304. The sheet discharge roller 301 is a rubber roller for discharging the recording sheet P after the recording is completed. The sheet discharge pinch roller 302 rotates together with and driven by the sheet discharge roller 301. The sheet discharge pinch roller holder 304 supports the sheet discharge pinch roller 302. The sheet discharge pinch roller 302 is pressed to contact the sheet discharge roller 301, by a sheet discharge pinch roller spring (not shown).

The conveyance section 200 conveys the recording sheet P to a recording position. The conveyance section 200 is placed on the downstream side in the direction of conveying the recording sheet P fed from the sheet feeding section 100. The conveyance section 200 includes a conveyance roller 201, a pinch roller 202, and a pinch roller holder 204. The conveyance roller 201 conveys the recording sheet during a recording operation. The pinch roller 202 rotates together with and driven by the conveyance roller 201. The pinch roller holder 204 supports the pinch roller 202. The conveyance roller 201 includes a metal shaft, and a plurality of rubber rollers which are coaxial with the metal shaft and each of which has the same diameter. The pinch roller 202 is pressed to contact the conveyance roller 201 by a pinch roller spring (not shown). The recording section 400 includes a platen 401, which supports the recording sheet P. The sheet discharge roller 301 and the conveyance roller 201 are driven by a conveying motor 205.

The driving force of the conveying motor 205 is transmitted to the conveyance roller 201 via a belt 206. Further, the driving force is transmitted to the sheet discharge roller 301 via an idler gear 208. A rotary encoder 212 for detecting the conveyance rate of a roller is attached to the idler gear 208, which connects the conveyance roller 201 with the sheet discharge roller 301. An encoder sensor 213 reads a slit printed on the rotary encoder 212, thereby detecting the revolution number of the roller, and consequently, the conveyance rate.

A trailing edge detection sensor 209 is placed at the back of the conveyance roller 201. The trailing edge detection sensor 209 is used for detecting an end part Pa which forms the trailing edge of the recording sheet P during recording operation, and an end part Pa which forms the leading edge of the recording sheet P when sheets are fed. The trailing edge detection sensor 209 is a light transmission type sensor and is shielded by a trailing edge detection sensor lever 210.

Figure 3:
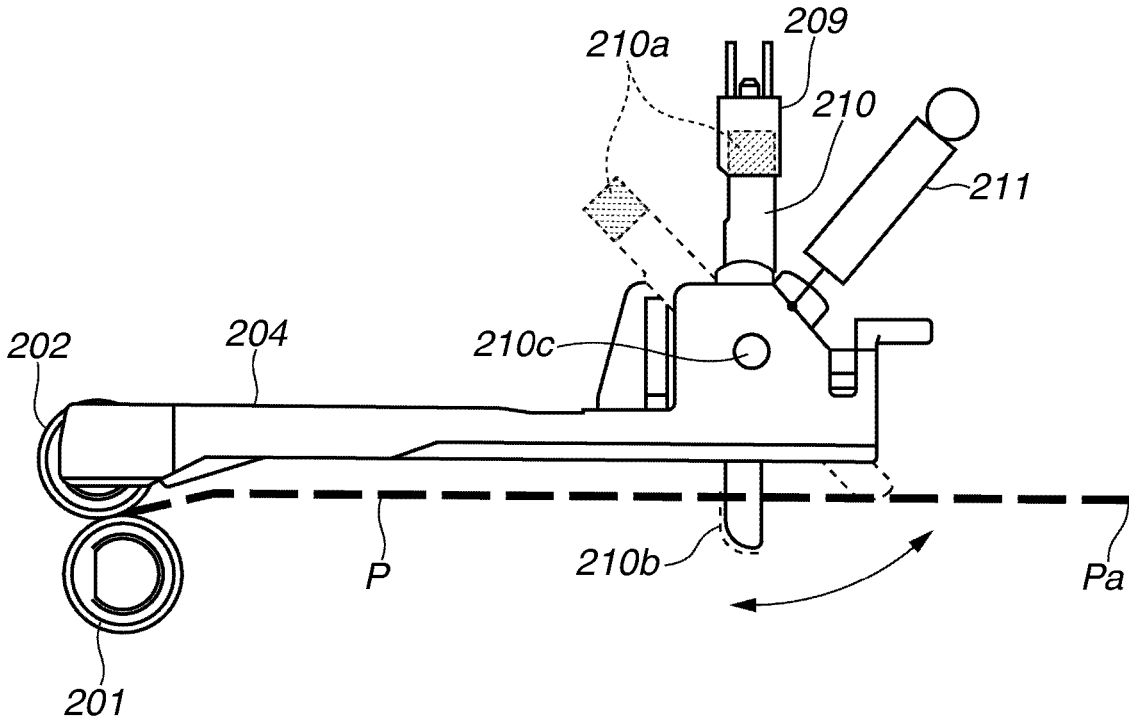
FIG. 3 is a schematic view illustrating the part of a trailing edge detection sensor according to a first exemplary embodiment of the present invention.

FIG. 3 is a schematic view illustrating the part of the trailing edge detection sensor 209. The trailing edge detection sensor lever 210 includes a sensor light shielding section 210*a* and a recording sheet contact section 210*b*, which the recording sheet P abuts. The trailing edge detection sensor lever 210 is attached to the pinch roller holder 204 pivoting about a rotation shaft 210*c*. The trailing edge detection sensor lever 210 is ordinarily urged in a position where the trailing edge detection sensor 209 is shielded by a spring 211.

Next, a detailed operation will be described. The sheet feeding rollers 102 and 103 are rotated by the sheet feed motor (not shown) to feed the stacked recording sheet P toward the nip section made of the sheet discharge roller 301 and the sheet discharge pinch roller 302.

At this time, the conveying motor 205 is at rest. The end part Pa (i.e., the leading edge of the recording sheet P at the time of feeding) abuts the nip section of the sheet discharge roller 301 and the sheet discharge pinch roller 302. After the recording sheet P abuts the end part Pa, the sheet feeding roller 102 is further rotated to align the recording sheet P along the nip section made of the sheet discharge roller 301 and the sheet discharge pinch roller 302. When the end part Pa (i.e., the leading edge of the recording sheet P at the time of feeding) abuts the nip section of the sheet discharge roller 301 and the sheet discharge pinch roller 302, the sheet discharge roller 301 and the sheet discharge pinch roller 302 can be rotated in a direction of discharging (i.e., conveying the recording sheet P to the left portion in FIG. 3).

Alternatively, the recording sheet P can be aligned as follows. First, when a sheet is fed, the sheet feed motor (not shown) and the conveying motor 205 are simultaneously driven to temporarily pass the end part Pa (i.e., the leading edge of the recording sheet P at the time of feeding) through the nip section made of the sheet discharge roller 301 and the sheet discharge pinch roller 302. Then, the sheet feed motor (not shown) is stopped in a state that the pressing plate 101 and the sheet feeding roller 102 hold the recording sheet P. In this state, a rotation of the conveying motor 205 is reversed to temporarily convey the end part Pa (i.e., the leading edge of the recording sheet P at the time of feeding) that passed through the nip section of the sheet discharge roller 301 and the sheet discharge pinch roller 302, to the left portion as shown in FIG. 2. Then, the end part Pa can be discharged from the nip section of the sheet discharge roller 301 and the sheet discharge pinch roller 302 so that the recording sheet P can be aligned at that point.

The end part P of the recording sheet P (i.e., the leading edge when a sheet is fed) is aligned at the nip section made of the sheet discharge roller 301 and the sheet discharge pinch roller 302. Then, the conveying motor 205 is driven to rotate the sheet discharge roller 301. Thus, the recording sheet P is drawn onto the platen 401. The recording sheet P further passes the conveyance roller 201, enters the recording sheet abutment section 210*b* of the trailing edge detection sensor lever 210 so as to turn the trailing edge detection sensor lever 210. Thus, the sensor light shielding section 210*a* releases the light shielding of the trailing edge detection sensor 209.

At this point, the conveyance rate of the sheet discharge roller 301 is detected from when the end part Pa (i.e., the leading edge of the recording sheet P) is aligned at the nip section made of the sheet discharge roller 301 and the sheet discharge pinch roller 302, until when the end part Pa is conveyed to the position where the light shielding of the trailing edge detection sensor 209 is released. This detection is executed by the rotary encoder 212 and the encoder sensor 213. Then, the difference between the actual distance from the nip section to the position where the light shielding of the trailing edge detection sensor 209 is released, and the conveyance rate of the sheet discharge roller 301, is calculated. The calculated difference is stored in a control section (not shown) including a storage area.

After the end part Pb (i.e., the trailing edge of the recording sheet P at the time of feeding) passes the recording start position C in FIG. 2, the rotation of the conveyance roller 201 is reversed to convey the recording sheet P in a direction B shown in FIG. 2, where the recording head H mounted on the carriage section 500 records an image while the recording sheet P is conveyed. In the latter half of recording operation, after the trailing edge Pb of the recording sheet P passes the conveyance roller 201 while being recorded, the recording sheet P is conveyed only by the sheet discharge roller 301.

The conveyance rate of the sheet discharge roller 301 at that time is a revised one in which deviation from an ideal conveyance rate calculated when the sheet is fed, is corrected.

In a conventional example, based on the recording performed on a recording sheet, the conveyance rate of a sheet discharge roller has been corrected. On the other hand, in the configuration of the present exemplary embodiment, the conveyance rate of the sheet discharge roller 301 is detected every time when recording is performed. That is, the recording apparatus according to the present exemplary embodiment can detect the conveyance rate of the sheet discharge roller before recording. Based on the detected value, the conveyance rate of the sheet discharge roller during recording is corrected. Thus, regardless of the sheet type or usage environment and without recording beforehand for the purpose of correction, the recording of the trailing edge of the recording sheet can be performed at the conveyance rate of the sheet discharge roller 301 optimum for the recording.

Second Exemplary Embodiment

In the first exemplary embodiment, as a sensor to detect the position of the recording sheet P, the light transmission type sensor and the detection sensor lever are used which shields the light transmission type sensor by the movement of the recording sheet P. However, the leading edge Pa (i.e., an end part of the conveyed recording sheet P at the time of feeding) can also be detected using the light reflection type sensor. Further, the light reflection type sensor can be mounted on the carriage section 500.

Third Exemplary Embodiment

Figure 4:
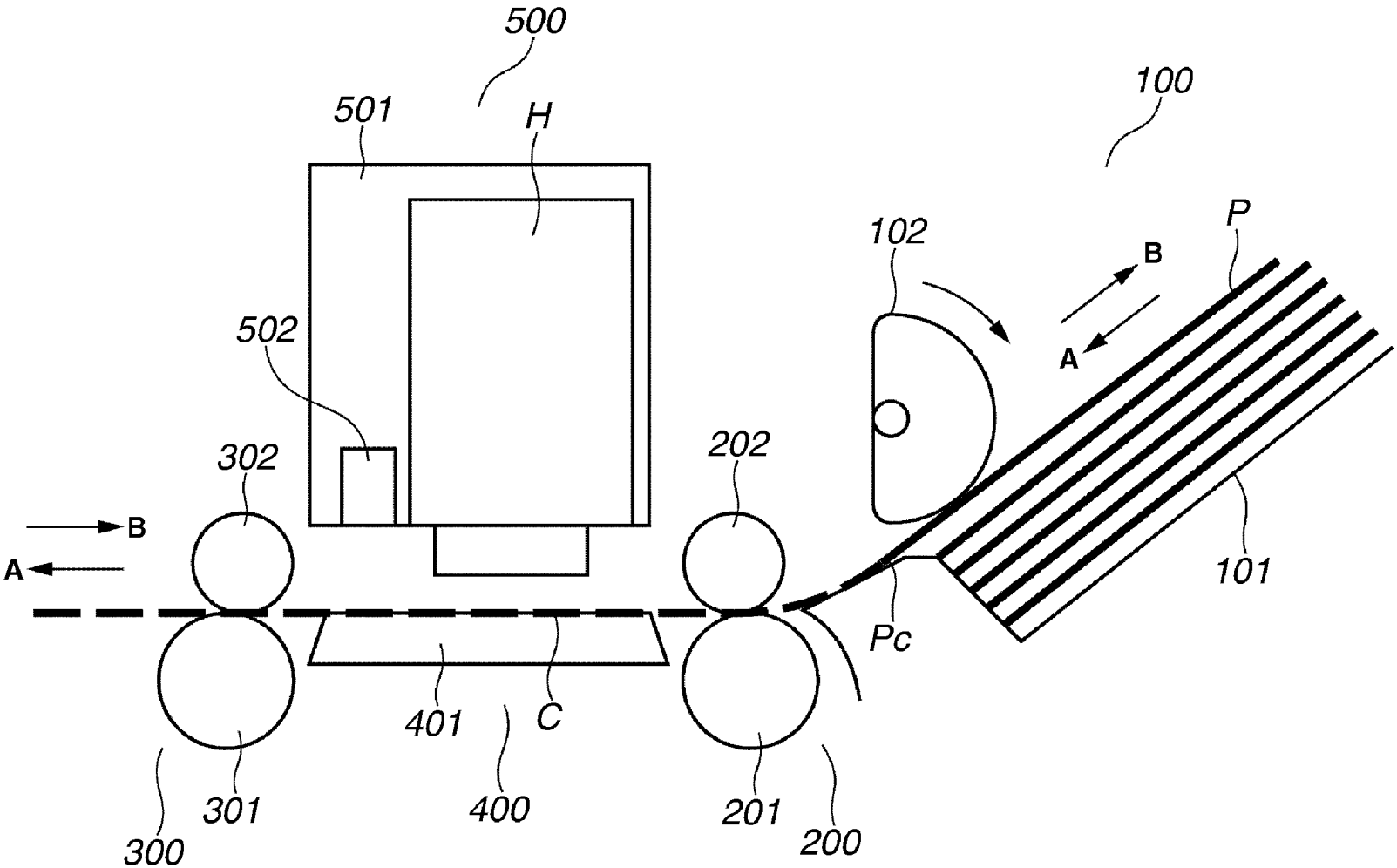
FIG. 4 is a cross sectional view illustrating a recording apparatus according to a third exemplary embodiment of the present invention.

FIG. 4 is a cross sectional view illustrating a recording apparatus according to a third exemplary embodiment of the present invention. Note that component members having the same function as the above-described exemplary embodiment will be described using numerals used in the first exemplary embodiment.

The recording apparatus according to the present exemplary embodiment includes a sheet feeding section 100, a conveyance section 200, a discharge section 300, a recording section 400, and a carriage section 500. The sheet feeding section 100 feeds a recording sheet P to a recording position. The discharge section 300 is positioned downstream from the conveyance section 200 in a sheet feeding direction A of the recording sheet P. The recording apparatus according to the first exemplary embodiment is configured such that the conveyance direction and the discharge direction of the recording sheet P are reversed. On the other hand, the recording apparatus according to the present exemplary embodiment is different from the first exemplary embodiment in that the conveyance direction and the discharge direction of the recording sheet P are the same.

The sheet feeding section 100 includes a sheet feeding roller 102 which is driven by a sheet feed motor (not shown). When the sheet feeding roller 102 rotates in an arrow direction shown in FIG. 4, an uppermost recording sheet P stacked on a pressing plate 101 is fed in a direction A shown in FIG. 4. The conveyance section 200 includes a conveyance roller 201 and a pinch roller 202. The pinch roller 202 rotates together with and driven by the conveyance roller 201 to convey the recording sheet P fed from the sheet feeding section 100 to the recording section 400 including a platen 401. The conveyance roller 201 is driven by a conveying motor (not shown). Further, a rotary encoder (not shown) for detecting the conveyance rate of a roller is attached to the conveyance roller 201. A rotary encoder sensor (not shown) reads a slit printed on the rotary encoder, thereby detecting the revolution number of the conveyance roller 201, and consequently, the conveyance rate.

The discharge section 300 includes a sheet discharge roller 301, and a sheet discharge pinch roller 302 which rotates together with and driven by the sheet discharge roller 301. The discharge section 300 conveys the recording sheet P that passed the conveyance roller 201, and discharges the recording sheet P after completing recording.

The carriage section 500 includes a carriage 501 that is mounted with a recording head H. In the carriage section 500, a sheet end detection sensor 502 is mounted downstream from the recording head H in the sheet feeding direction on the carriage 501. The sheet end detection sensor 502 can be a reflection type sensor for detecting the end part Pc (i.e., the leading edge at the time of feeding and recording the recording sheet P conveyed on the platen 401).

The sheet end detection sensor 502 is placed closer to the sheet discharge roller 301 than the conveyance roller 201 for the following reason: When the recording sheet P is conveyed on the platen 401, a sliding resistance, which influences the conveyance rate of the conveyance roller 201, is generated between the platen 401 and the recording sheet P. Accordingly, in order to grasp the accurate amount of the conveyance rate of the conveyance roller 201, it is desirable to detect the conveyance rate including the sliding resistance. In the present exemplary embodiment, the sheet end detection sensor 502 is placed closer to the sheet discharge roller 301 than the conveyance roller 201. That is, the sheet end detection sensor 502 is mounted downstream from the platen 401 in the sheet feeding direction. Accordingly, the conveyance rate including the above-described sliding resistance can be detected by the conveyance roller 201.

Next, the detailed operation will be described. The sheet feeding roller 102 is rotated by the conveying motor (not shown) to feed the stacked recording sheet P toward the nip section made of the conveyance roller 201 and the pinch roller 202. At this time, the sheet feeding motor (not shown) is at rest. The end part Pc (i.e., the leading edge of the recording sheet P at the time of feeding and recording) abuts the nip section of the conveyance roller 201 and the pinch roller 202. After the end part Pc makes an abutment, the sheet feeding roller 102 is further rotated, thus the recording sheet P is aligned along the nip section of the conveyance roller 201 and the pinch roller 202. In this exemplary embodiment, when the leading edge Pc of the recording sheet P abuts the nip section of the conveyance roller 201 and the pinch roller 202, the conveyance roller 201 and the pinch roller 202 can be rotated in a direction of conveying the recording sheet P in a direction B shown in FIG. 4.

Further, the recording sheet P can also be aligned as follows: When sheets are fed, the conveying motor (not shown) and the sheet conveyance motor (not shown) are simultaneously driven to temporarily pass the end part Pc (i.e., the leading edge of the recording sheet P at the time of feeding) through the nip section formed by the conveyance roller 201 and the pinch roller 202. Then, the sheet feeding motor (not shown) is stopped in a state that the pressing plate 101 and the sheet feeding roller 102 hold the recording sheet P. In this state, rotation of the conveying motor (not shown) is reversed to temporarily convey in the direction B shown in FIG. 4 the end part Pc (i.e., the leading edge of the recording sheet P at the time of feeding) which once passed through the nip section of the conveyance roller 201 and the pinch roller 202.

Then, the recording sheet P can be discharged from the nip section of the conveyance roller 201 and the pinch roller 202 to be aligned there.

The leading edge Pc (an end part of the recording sheet P at the time of feeding) is aligned at the nip section of the conveyance roller 201 and the pinch roller 202. Thereafter, the conveying motor (not shown) is driven to rotate the conveyance roller 201 so that the recording sheet P is drawn onto the platen 401. Then, the recording sheet P is conveyed to the position where the sheet end detection sensor 502 mounted on the carriage 501 detects the leading edge Pc of the recording sheet P.

Here, the conveyance rate of the conveyance roller 201 is detected, from when the leading edge Pc of the recording sheet P is aligned along the nip section made of the conveyance roller 201 and the pinch roller 202, until when it is detected by the sheet end detection sensor 502. This detection is executed by the rotary encoder (not shown) and the encoder sensor (not shown). Then, the difference between the actual distance from the nip section of the conveyance roller 201 and the pinch roller 202 to the position where the sheet end detection sensor 502 detects the leading edge Pc of the recording sheet P, and the conveyance rate of the conveyance roller 201, is calculated. The calculated difference is stored in a control section (not shown) including a storage area.

After the leading edge Pc of the recording sheet P is detected by the sheet end detection sensor 502, rotation of the conveyance roller 201 is reversed to convey the recording sheet P in the direction B shown in FIG. 4 until the leading edge Pc passes through the recording start position C. Thereafter, the conveyance roller 201 rotates in the normal direction again to record an image by the recording head H mounted on the carriage section 500 while the recording sheet p is conveyed in the direction A. Here, the conveyance rate of the conveyance roller 201 is a revised one in which deviation from an ideal conveyance rate calculated when the sheet is fed, is corrected.

In a conventional example, based on the recording performed on a recording sheet, the conveyance rate of a conveyance roller has been corrected. On the other hand, the configuration according to the present exemplary embodiment detects the conveyance rate of the conveyance roller 202 every time when the recording is performed. That is, the recording apparatus according to the present exemplary embodiment can detect the conveyance rate of the conveyance roller 201 before recording an image. Based on the detected value, the conveyance rate of the conveyance roller 201 during the recording is corrected. Thus, regardless of the sheet type or usage environment, and without performing recording for correction beforehand, the recording of the trailing edge of the recording sheet can be made at the conveyance rate of the roller 201 optimum for recording.

Fourth Exemplary Embodiment

Figure 5:
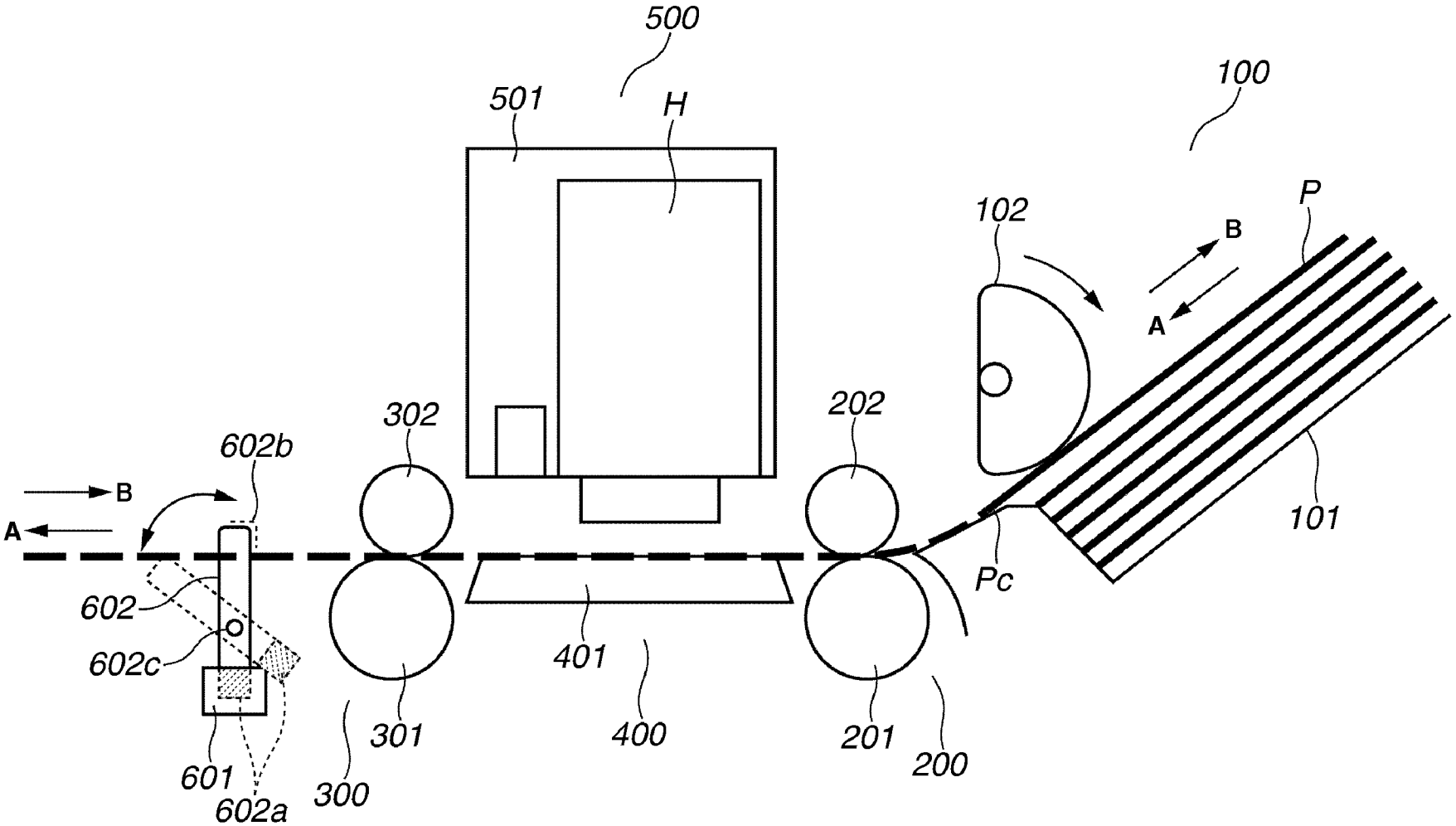
FIG. 5 is a cross sectional view illustrating a recording apparatus according to a fourth exemplary embodiment of the present invention.

FIG. 5 is a cross sectional view illustrating a recording apparatus according to a fourth exemplary embodiment of the present invention. Note that component members having the same function as the above-described exemplary embodiment will be described using numerals used in the first and the second exemplary embodiments.

The recording apparatus according to the present exemplary embodiment includes a sheet feeding section 100 for feeding a recording sheet P to a recording position, a conveyance section 200, a discharge section 300, a recording section 400, and a carriage section 500. The discharge section 300 is positioned downstream from the conveyance section 200 in a sheet feeding direction A of the recording sheet P.

The sheet feeding section 100 includes a sheet feeding roller 102 which is driven by a conveying motor (not shown). When the sheet feeding roller 102 rotates in an arrow direction shown in FIG. 5, the uppermost recording sheet P stacked on a pressing plate 101 is fed in the direction A shown in FIG. 5. The conveyance section 200 includes a conveyance roller 201 and a pinch roller 202, which rotates together with and driven by the conveyance roller 201 to convey the recording sheet P fed from the sheet feeding section 100 to the recording section 400 including a platen 401. The conveyance roller 201 is driven by a sheet feeding motor (not shown). Further, a rotary encoder (not shown) for detecting the conveyance rate of a roller is attached to the conveyance roller 201. A rotary encoder sensor (not shown) reads a slit printed on the rotary encoder, thereby detecting the revolution number of a roller, and consequently the conveyance rate.

The discharge section 300 includes a sheet discharge roller 301 and a sheet discharge pinch roller 302, which rotates together with and driven by the sheet discharge roller 301 to convey the recording sheet P that passed through the conveyance roller 201. The discharge section 300 discharges the recording sheet P after recording is completed. In this exemplary embodiment, the sheet discharge pinch roller 302 is detachably attached to the sheet discharge roller 301 by an elevating mechanism (not shown). Downstream in the sheet feeding direction from the sheet discharge roller 301, a sheet end detection sensor 601 is placed for detecting the recording sheet P conveyed on the platen 401. The sheet end detection sensor 601 can be a light transmission type sensor and is shielded by a sheet end detection sensor lever 602. The sheet end detection sensor lever 602 includes a sensor light shielding section 602*a* and a recording sheet abutment section 602*b* which the recording sheet P contacts. The sheet end detection sensor lever 602 is attached pivoting about the rotation shaft 602*c*. The sheet end detection sensor lever 602 is ordinarily urged in a position where the sheet end detection sensor 601 is shielded by a sheet end detection sensor spring (not shown).

When the recording sheet P is conveyed on the platen 401, a sliding resistance that influences the conveyance rate of the conveyance roller 201 is generated between the platen 401 and the recording sheet P. Accordingly, in order to grasp the accurate amount of the conveyance rate of the conveyance roller 201, it is necessary to detect the conveyance rate including the sliding resistance. In the present exemplary embodiment, the sheet end detection sensor 602 is placed closer to the sheet discharge roller 301 than the conveyance roller 201. That is, the sheet end detection sensor 602 is placed downstream from the platen 401 in the sheet feeding direction and further from the sheet discharge roller 301. Accordingly, the conveyance rate including the above-described sliding resistance can be more accurately detected by the conveyance roller 201.

Next, the detailed operation will be described. The sheet feeding roller 102 is rotated by the conveying motor (not shown) to feed the stacked recording sheet P toward the nip section made of the conveyance roller 201 and the pinch roller 202. At this time, the sheet feeding motor (not shown) is at rest. The fed recording sheet P abuts the nip section of the conveyance roller 201 and the pinch roller 202. After the recording sheet P makes an abutment, the sheet feeding roller 102 is further rotated, thus the recording sheet P is aligned along the nip section of the conveyance roller 201 and the pinch roller 202.

The leading edge Pc (i.e., an end part of the recording sheet P at the time of feeding) is aligned at the nip section of the conveyance roller 201 and the pinch roller 202. Then, the conveying motor (not shown) is driven to rotate the conveyance roller 201, and the recording sheet P is drawn onto the platen 401. The recording sheet P further passes the sheet discharge roller 301. At this time, the sheet discharge pinch roller 302 is detached from the sheet discharge roller 301 by the elevating mechanism (not shown) so that the sheet discharge roller 301 does not influence conveyance performed by the conveyance roller 201. The recording sheet P passes the sheet discharge roller 301 and the leading edge Pc enters the recording sheet abutment section 602*b* of the sheet end detection sensor lever 602. Then, the leading edge Pc turns the sheet end detection sensor lever 602 and the sensor light shielding section 602*a* releases the light shielding of the sheet end detection sensor 601.

Here, the conveyance rate of the conveyance roller 201 is detected, from when the leading edge Pc of the recording sheet P is aligned at the nip section made of the conveyance roller 201 and the pinch roller 202, until when the light shielding of the sheet end detection sensor 601 is released. This detection is executed by the rotary encoder (not shown) and the encoder sensor (not shown). Then, the difference between the actual distance from the nip section of the conveyance roller 201 and the pinch roller 202 to the position to release the light shielding of the sheet end detection sensor 601, and the conveyance rate of the roller 201, is calculated and the calculated difference is stored in a control section (not shown) including a storage area.

After the leading edge Pc of the recording sheet P is detected by the sheet end detection sensor 601, rotation of the conveyance roller 201 is reversed to convey the recording sheet P in a direction B shown in FIG. 5 until the leading edge Pc of the recording sheet passes the recording start position C. Thereafter, the sheet discharge pinch roller 302 abuts and contacts the sheet discharge roller 301 driven by the elevating mechanism (not shown). The conveyance roller 201 rotates again in a normal direction so that recording is performed by the recording head H mounted on the carriage section 500 while the recording sheet p is conveyed in a direction A. Here, the conveyance rate of the roller 201 is a revised one in which deviation from an ideal conveyance rate calculated when the sheet is fed, is corrected.

In a conventional example, based on the recording performed on a recording sheet, the conveyance rate of a conveyance roller has been corrected. On the other hand, the configuration according to the present exemplary embodiment detects the conveyance rate of the conveyance roller 202 every time when the recording is performed. That is, the recording apparatus according to the present exemplary embodiment can detect the conveyance rate of the conveyance roller 201 before recording an image. Based on the detected value, the conveyance rate of the conveyance roller 201 during the recording is corrected. Thus, regardless of the sheet type or usage environment, and without performing recording for correction beforehand, the recording of the trailing edge can be made at the conveyance rate of the roller 201 optimum for recording.

According to the exemplary embodiment of the present invention, before recording an image, based on a result detected by a recording sheet detection unit and a result detected by a conveyance rate detection unit, the conveyance rate of the conveyance roller can be corrected. Accordingly, the conveyance rate of the conveyance roller can be corrected without recording an unnecessary image such as a test pattern.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-161052 filed Jun. 9, 2006, which is hereby incorporated by reference herein in its entirety.

What is claimed is:

1. A recording apparatus comprising:

a feeding section configured to feed a recording sheet;

a first conveyance roller disposed downstream relative to the feeding section in a direction of feeding the recording sheet, and configured to convey the recording sheet fed from the feeding section to a recording area and to convey the recording sheet during a recording operation;

a recording section configured to record an image on the recording sheet at the recording area downstream relative to the first conveyance roller in the direction of feeding the recording sheet;

a conveyance rate detection unit configured to detect the conveyance rate of the recording sheet conveyed by the first conveyance roller;

a recording sheet detection unit disposed downstream relative to the first conveyance roller in the direction of feeding the recording sheet, and configured to detect the end part of the recording sheet; and a correction unit configured to correct the conveyance rate of the recording sheet conveyed by the first conveyance roller, based on the detection by the conveyance rate detection unit and the recording sheet detection unit, wherein the first conveyance roller conveys the recording sheet until the recording sheet detection unit detects the end part of the recording sheet before the recording section starts recording.

2. The recording apparatus according to claim 1, wherein the recording sheet detection unit is disposed downstream relative to the recording section in the direction of feeding the recording sheet.

3. The recording apparatus according to claim 1, further comprising a second conveyance roller disposed downstream relative to the first conveyance roller and the recording section in the direction of feeding the recording sheet, and conveys the recording sheet during the recording operation, wherein the recording sheet detection unit is disposed downstream relative to the second conveyance roller in the direction of feeding the recording sheet.

4. The recording apparatus according to claim 1, further comprising a platen supporting the recording sheet at the recording area, wherein the recording sheet reciprocally moves on the platen driven by the first and the second conveyance rollers.

5. The recording apparatus according to claim 1, further comprising an idler roller rotating together with and driven by the first conveyance roller, wherein when the recording sheet is fed, the end part of the recording sheet temporarily abuts a nip section of the first conveyance roller in a state of being stopped, and the idler roller.

6. The recording apparatus according to claim 1, wherein the conveyance rate detection unit detects the conveyance rate, from when the fed recording sheet is conveyed from the nip section formed of the first conveyance roller and the idler roller rotating together with and driven by the first conveyance roller, until when the recording sheet detection unit detects the end part of the recording sheet, and wherein the correction unit calculates the difference between the conveyance rate detected by the conveyance rate detection unit, and the distance from the nip section to the point where the recording sheet detection unit detects the end part of the recording sheet, so that the conveyance rate of the first conveyance roller is corrected during the recording operation based on the calculated difference.

7. The recording apparatus according to claim 1, wherein the first conveyance roller includes a metal shaft and a plurality of rubber roller sections that are coaxial with the metal shaft and have the same diameter.

8. The recording apparatus according to claim 3, wherein the recording sheet detection unit is disposed closer to the second conveyance roller than the first conveyance roller.

9. The recording apparatus according to claim 1, wherein the recording sheet detection unit includes a light transmission type sensor and a lever member having a light shielding section adapted to shield the light transmission type sensor and an abutment section which the recording sheet abuts.

10. The recording apparatus according to claim 1, wherein the recording sheet detection unit detects a trailing edge of the recording sheet during the recording operation.

11. The recording apparatus according to claim 1, wherein the recording sheet detection unit includes a light reflection type sensor.

12. The recording apparatus according to claim 11, wherein the light reflection type sensor is mounted on the recording section.

13. The recording apparatus according to claim 1, wherein the detection unit includes a rotary encoder and an encoder sensor reading the rotary encoder.

* * * * *